US010522272B2

(12) United States Patent
Peterson et al.

(10) Patent No.: US 10,522,272 B2
(45) Date of Patent: Dec. 31, 2019

(54) METHOD OF MANUFACTURING A TWISTED PAIR WIRE CABLE AND A TWISTED PAIR WIRE CABLE FORMED BY SAID METHOD

(71) Applicant: Delphi Technologies, LLC, Troy, MI (US)

(72) Inventors: David R. Peterson, Aurora, OH (US); Sean P. Krompegel, Canfield, OH (US); Raianna Hnida, Pulaski, PA (US)

(73) Assignee: Delphi Technologies, LLC, Troy, MI (US)

( * ) Notice: Subject to any disclaimer, the term of this patent is extended or adjusted under 35 U.S.C. 154(b) by 0 days.

(21) Appl. No.: 15/891,687

(22) Filed: Feb. 8, 2018

(65) Prior Publication Data

US 2019/0244727 A1 Aug. 8, 2019

(51) Int. Cl.
*H01B 11/02* (2006.01)
*H01B 13/00* (2006.01)

(52) U.S. Cl.
CPC ..... *H01B 13/0036* (2013.01); *H01B 11/02* (2013.01)

(58) Field of Classification Search
CPC ... H01B 5/02; H01B 5/04; H01B 7/02; H01B 7/04; H01B 11/02; H01B 11/04; H01B 13/02; H01B 13/0036
USPC ..... 174/102 R, 103, 110 R, 113 R, 115, 116, 174/28, 29
See application file for complete search history.

(56) References Cited

U.S. PATENT DOCUMENTS 3,102,160 A * 8/1963 Cook ..... H01B 7/361 174/103
4,356,345 A * 10/1982 Gonia ..... B29C 66/69 156/47
5,015,800 A * 5/1991 Vaupotic ..... H01B 11/002 156/51
5,334,271 A * 8/1994 Bullock ..... B29C 65/48 156/244.12
5,606,151 A * 2/1997 Siekierka ..... H01B 11/002 174/110 R
5,658,406 A * 8/1997 Walling ..... B29C 47/0016 156/244.12
6,222,129 B1 * 4/2001 Siekierka ..... C08L 23/10 174/110 F
6,273,977 B1 * 8/2001 Harden ..... H01B 13/0023 156/244.12
6,506,814 B2 * 1/2003 Krongauz ..... C08F 290/147 522/33

(Continued)

FOREIGN PATENT DOCUMENTS

JP H0794042 A * 4/1995 ..... G11B 5/60

*Primary Examiner* — William H. Mayo, III
(74) *Attorney, Agent, or Firm* — Robert J. Myers

(57) ABSTRACT

A method of manufacturing a twisted pair wire cable includes the step of arranging a first wire cable in a parallel orientation with a second wire cable. The first and second wire cables each have a conductive inner core and an insulative jacket surrounding the inner core. The method further includes the steps of applying a curable adhesive, such as a urethane acrylate oligomer based adhesive, to the jackets of the first and second wire cables, twisting the first and second wire cables one about the other, and curing the adhesive.

19 Claims, 5 Drawing Sheets

(56) References Cited

U.S. PATENT DOCUMENTS

| | | | | |
|---|---|---|---|---|
| 7,049,523 | B2 * | 5/2006 | Shuman | G02B 6/441 174/113 R |
| 2006/0021772 | A1 * | 2/2006 | Dellagala | H01B 11/002 174/27 |
| 2016/0343471 | A1 * | 11/2016 | Ernst | H01B 7/0275 |

* cited by examiner

METHOD OF MANUFACTURING A TWISTED PAIR WIRE CABLE AND A TWISTED PAIR WIRE CABLE FORMED BY SAID METHOD

TECHNICAL FIELD OF THE INVENTION

The invention relates to a method of manufacturing a twisted pair wire cable.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

The method for forming a twisted pair wire electrical cable, such as those used for differential data transmission, is presented herein. A pair of parallel wires is first coated with a curable adhesive, twisted about each other, and then the adhesive is cured to yield a twisted pair cable.

FIGS. 1 through 7 illustrate an example of a method 100 of manufacturing a twisted pair cable 200, an apparatus 300 capable of performing the method 100, and the twisted pair cable 200 obtained from this method 100. The method 100 includes the following steps.

Figure 1:
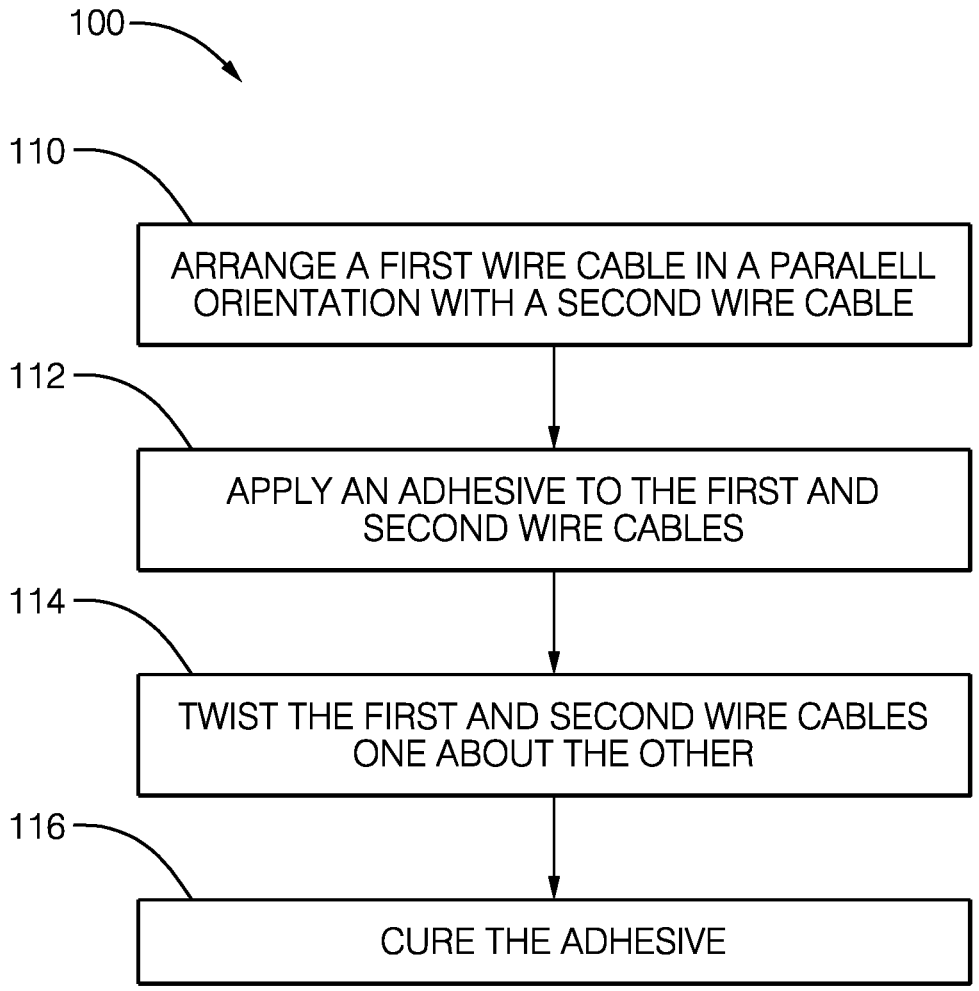
FIG. 1 is a flowchart for a method of manufacturing a twisted pair wire cable according to one embodiment of the invention.
Figure 2:
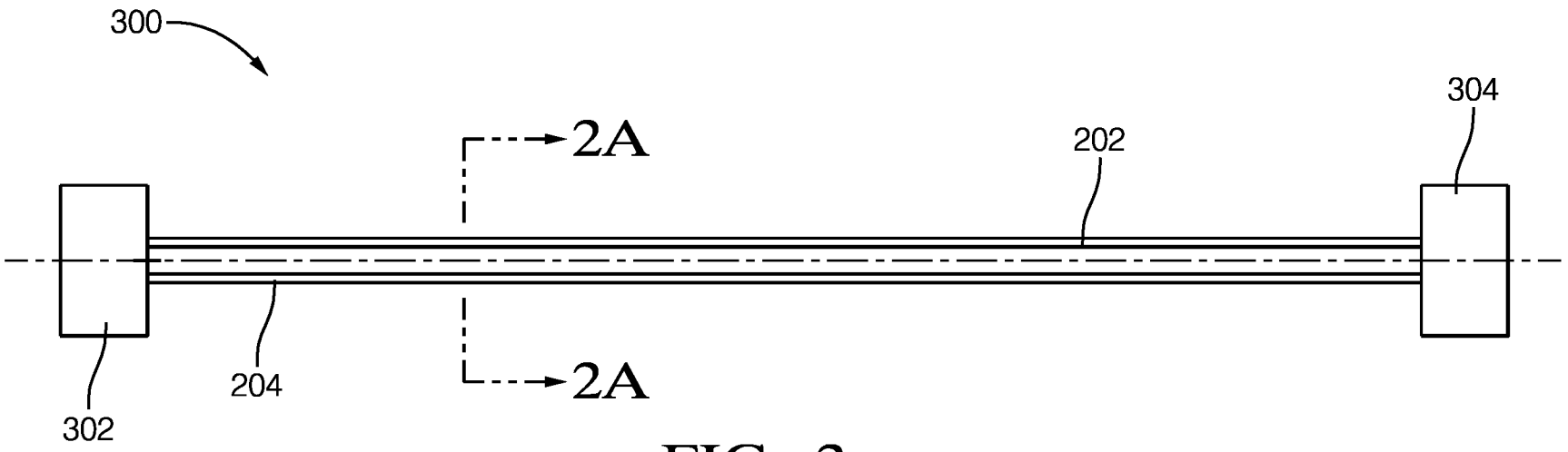
FIG. 2 is partial side view of a pair of wire cables in an apparatus configured to perform a first step of the method of FIG. 1 according to one embodiment.
Figure 2A:
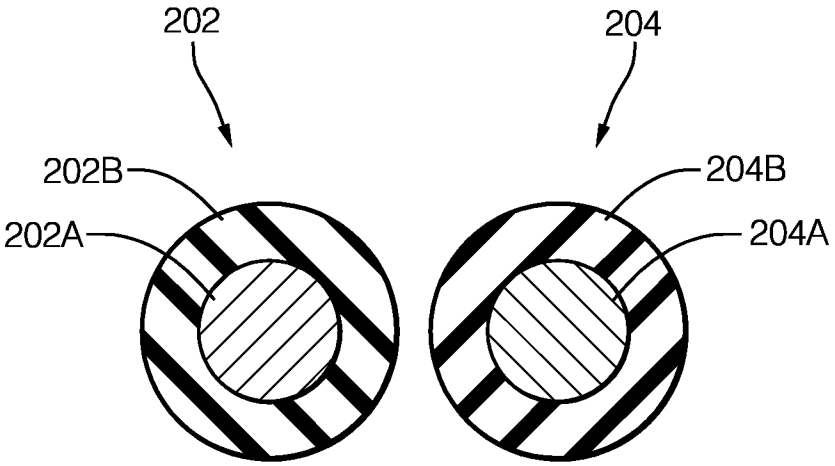
FIG. 2A is cross section view of the pair of wire cables of FIG. 2 according to one embodiment.

STEP 110, ARRANGE A FIRST WIRE CABLE IN A PARALLEL ORIENTATION WITH A SECOND WIRE CABLE, includes arranging a first wire cable 202 in a parallel orientation with a second wire cable 204 within a first clamp 302 and second clamp 304 of the apparatus 300 as shown in FIG. 2. The first and second wire cables 202, 204 each have a conductive inner core 202A, 204A and an insulative jacket 202B, 204B surrounding the inner core 202A, 204A as shown in FIG. 2A. The conductive inner core 202A, 204A is typically metallic, e.g. a strand or strands of copper or aluminum alloy, but could alternatively be a non-metallic electrical conductor such as a stand of carbon nanotubes or conductive polymer.

Figure 3:
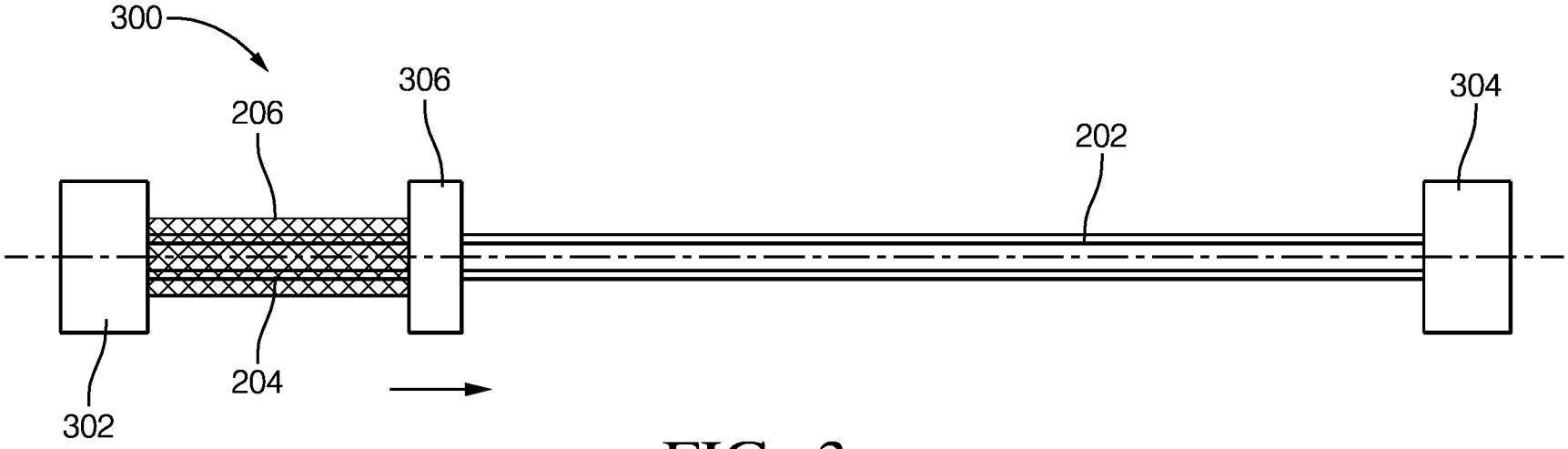
FIG. 3 is partial side view of a pair of wire cables in an apparatus configured to perform a second step of the method of FIG. 1 according to one embodiment.
Figure 4:
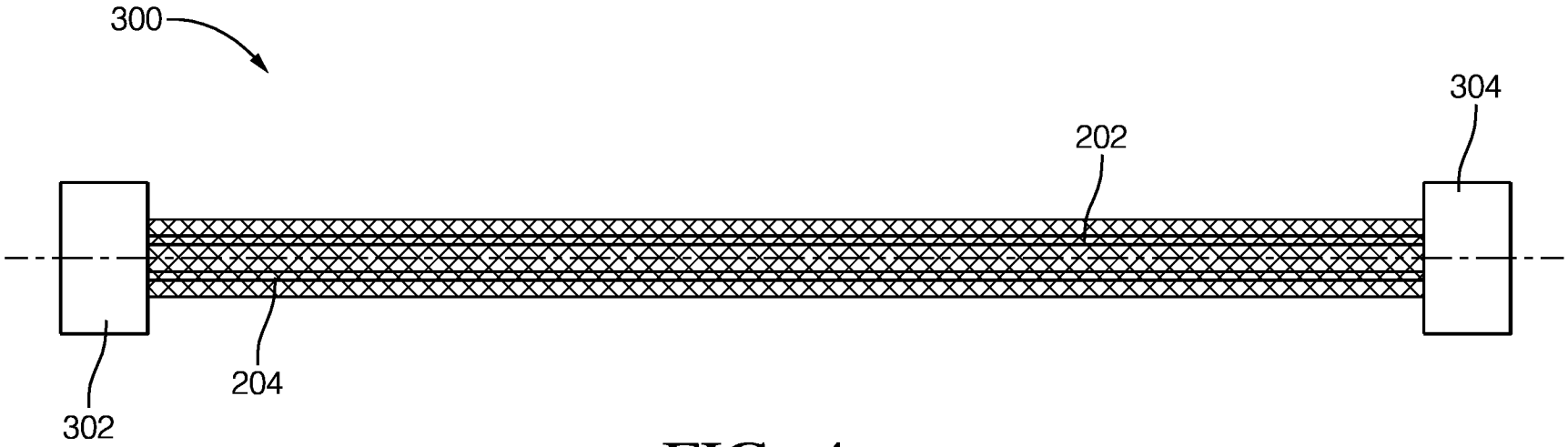
FIG. 4 is partial side view of a pair of wire cables in the apparatus after the second step of the method of FIG. 1 is performed according to one embodiment.
Figure 5:
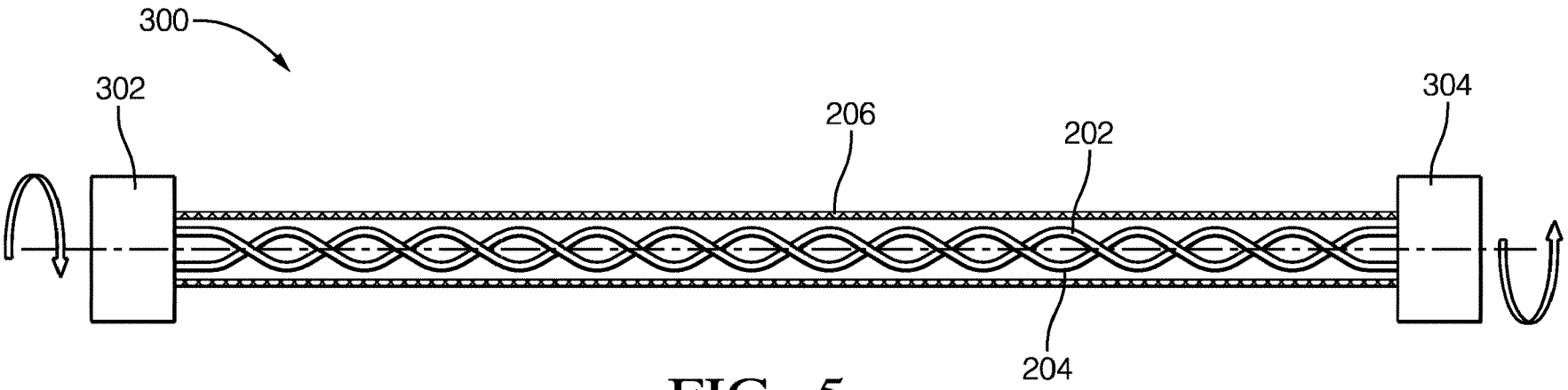
FIG. 5 is partial side view of a pair of wire cables in an apparatus configured to perform a third step of the method of FIG. 1 according to one embodiment.

STEP 112, APPLY AN ADHESIVE TO THE FIRST AND SECOND WIRE CABLES, includes applying an uncured adhesive 206 to the jackets 202B, 204B of the first and second wire cables 202, 204. The uncured adhesive 206 may be applied by a moveable applicator 306 that automatically moves along the length of the first and second wire cables 202, 204 to apply the uncured adhesive 206 to the jackets 202B, 204B as shown in FIG. 3. The applicator 306 is preferably a component of the apparatus 300. The uncured adhesive 206 may be applied by brushing, spraying, or extruding the adhesive over the jackets 202B, 204B. In alternative embodiments, the uncured adhesive 206 may be manually applied to the jackets 202B, 204B. The inventors have discovered that a urethane acrylate oligomer based adhesive is preferred. The uncured adhesive 206 may be colorless, i.e. the natural color of the adhesive, or may contain colorants or fluorescent additives that can be used to distinguish the twisted wire cable in subsequent assembly or service processes. Preferably, the uncured adhesive 206 is continuously applied along the length of the first and second wire cables 202, 204 as shown in FIG. 4. However, according to other embodiments, the uncured adhesive 206 may be intermittently applied along the length of the first and second wire cables 202, 204.

STEP 114, TWIST THE FIRST AND SECOND WIRE CABLES ONE ABOUT THE OTHER, includes twisting the first and second wire cables 202, 204 one about the other so that the twisted pair has a predetermined twist, typically identified by a twist rate per unit length or lay length of one twist of the cable. The first and second wire cables 202, 204 are twisted by rotating one or both of the clamps 302, 304 of the apparatus 300 until the predetermined twist of the first and second wire cables 202, 204 is achieved, In alternative embodiments, the first and second wire cables 202, 204 may be manually twisted.

Figure 6:
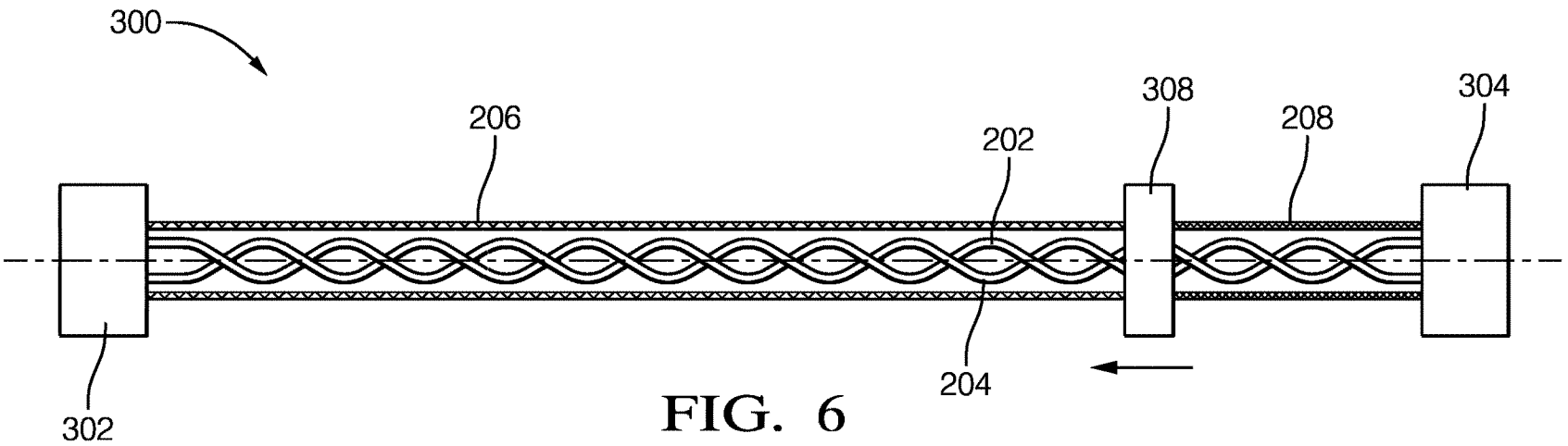
FIG. 6 is partial side view of a pair of wire cables in an apparatus configured to perform a fourth step of the method of FIG. 1 according to one embodiment.
Figure 7:
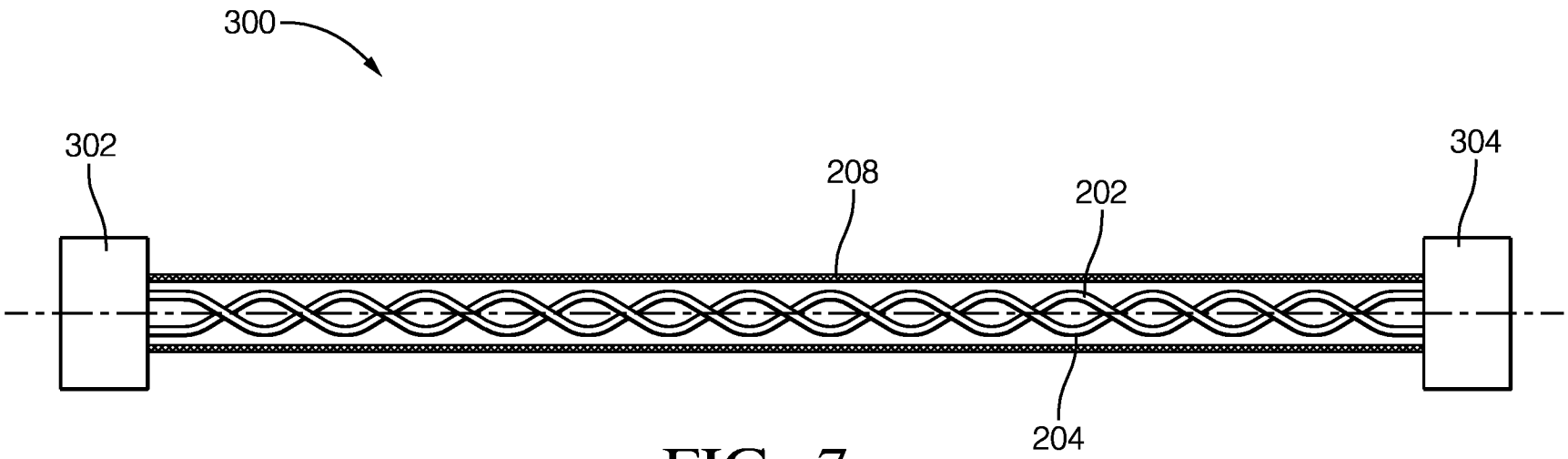
FIG. 7 is partial side view of a pair of wire cables in the apparatus after the fourth step of the method of FIG. 1 is performed according to one embodiment.

STEP 116, CURE THE ADHESIVE, includes curing the uncured adhesive 206. The uncured adhesive 206 may be cured by applying heat, ultraviolet (UV) light, or a catalyst to the uncured adhesive 206 or exposing the uncured adhesive 206 to air. The preferred urethane acrylate oligomer based adhesive is cured by exposure to UV light, so the apparatus 300 includes a moveable UV illuminator 308 that automatically moves along the length of the first and second wire cables 202, 204, as shown in FIG. 6, to expose the uncured adhesive 206 to the UV light source in the UV illuminator, thereby producing a cured adhesive 208. After the cured adhesive 208 is formed, as shown in FIG. 7, the twisted pair cable 200 may be removed from the clamps 302, 304 of the apparatus 300 for further processing, such as termination and incorporation into a wire harness.

Accordingly, a method 100 of manufacturing a twisted pair wire cable and a twisted pair cable 200 formed by this method 100 is provided. This method 100 of forming a twisted pair cable 200 offers the advantages of eliminating the need for a covering over the first and second wire cables 202, 204, such as a tape wrapped about the pair or a jacket extruded over the first and second wire cables 202, 204 and the associated material costs and manufacturing processes required to apply the covering to the first and second wire cables 202, 204. The method 100 also provides the benefit of inhibiting separation of the first and second wire cables 202, 204 that can degrade the electrical performance of the twisted pair cable 200.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. A method of manufacturing a twisted pair wire cable, comprising the steps of:

arranging a first wire cable in a parallel orientation with a second wire cable, wherein the first and second wire cables each have a conductive inner core and an insulative jacket surrounding the conductive inner core;

applying a curable adhesive to the insulative jackets of the first and second wire cables;

twisting the first and second wire cables one about the other; and curing the adhesive by exposing the curable adhesive to ultraviolet light using a moveable ultraviolet illuminator that moves along the length of the first and second wire cables.

2. The method according to claim 1, wherein the steps of the method are performed in the order recited.

3. The method according to claim 1, wherein the adhesive is applied continuously along the first and second wire cables.

4. The method according to claim 1, wherein the adhesive is a urethane acrylate oligomer based adhesive.

5. The method according to claim 1, wherein the ultraviolet illuminator moves automatically along the length of the first and second wire cables to expose the adhesive to a ultraviolet light source in the ultraviolet illuminator.

6. The method according to claim 1, wherein the step of applying a curable adhesive to the insulative jackets of the first and second wire cables is performed using a moveable applicator that moves along a length of the first and second wire cables.

7. The method according to claim 6, wherein the moveable applicator automatically moves along the length of the first and second wire cables.

8. The method according to claim 1, wherein the adhesive comprises a colorant.

9. The method according to claim 8, wherein the colorant is a florescent colorant.

10. A twisted pair wire cable, formed by a method comprising the steps of:

arranging a first wire cable in a parallel orientation with a second wire cable, wherein the first and second wire cables each have a conductive inner core and an insulative jacket surrounding the conductive inner core;

applying a curable adhesive to the insulative jackets of the first and second wire cables;

twisting the first and second wire cables one about the other; and curing the adhesive by exposing the curable adhesive to ultraviolet light using a moveable ultraviolet illuminator that moves along the length of the first and second wire cables.

11. The twisted pair wire cable according to claim 10, wherein the steps of the method are performed in the order recited.

12. The twisted pair wire cable according to claim 10, wherein the adhesive is applied continuously along the first and second wire cables.

13. The twisted pair wire cable according to claim 10, wherein the adhesive is a urethane acrylate oligomer based adhesive.

14. The twisted pair wire cable according to claim 11, wherein the step of curing the adhesive is performed by exposing the curable adhesive to heat.

15. The twisted pair wire cable according to claim 10, wherein the ultraviolet illuminator moves automatically along the length of the first and second wire cables to expose the adhesive to a ultraviolet light source in the ultraviolet illuminator.

16. The twisted pair wire cable according to claim 10, wherein the step of applying a curable adhesive to the insulative jackets of the first and second wire cables is performed using a moveable applicator that moves along a length of the first and second wire cables.

17. The twisted pair wire cable according to claim 16, wherein the moveable applicator automatically moves along the length of the first and second wire cables.

18. The twisted pair wire cable according to claim 10, wherein the adhesive comprises a colorant.

19. The twisted pair wire cable according to claim 18, wherein the colorant is a florescent colorant.

* * * * *